United States Patent [19]

Maeda et al.

[11] Patent Number: 4,850,836

[45] Date of Patent: Jul. 25, 1989

[54] MELT SPINNING APPARATUS

[75] Inventors: Naoyuki Maeda, Tokyo; Akira Nii, Kawasaki; Shunichi Yamamoto, Kamakura; Seiichi Uemura, Tokyo, all of Japan

[73] Assignee: Nippon Oil Company, Limited, Japan

[21] Appl. No.: 242,699

[22] Filed: Sep. 9, 1988

Related U.S. Application Data

[63] Continuation of Ser. No. 833,739, Feb. 26, 1986, abandoned.

[30] Foreign Application Priority Data

Mar. 4, 1985 [JP] Japan ..... 60-41089

[51] Int. Cl.[4] ..... D01D 5/08

[52] U.S. Cl. ..... 425/72.2; 264/211.14; 425/378.2

[58] Field of Search ..... 264/177.17, 177.18, 264/177.19, 211.14–211.17, 237, 29.1, 29.2, 29.6, 29.7; 425/72.1, 72.2, 66, 192 S, 378.2, 382.2, 464

[56] References Cited

U.S. PATENT DOCUMENTS

| | | | |
|---|---|---|---|
| 3,299,469 | 1/1967 | Charlton | 425/72.2 |
| 3,508,296 | 4/1970 | Ono | 425/72.2 |
| 3,672,801 | 6/1972 | Caldwell et al. | 425/71 |
| 3,824,050 | 7/1974 | Balk | 425/72.2 |
| 4,259,048 | 3/1981 | Miani | 425/72.2 |
| 4,424,927 | 1/1984 | Cardell | 425/72.2 |
| 4,436,688 | 3/1984 | Koschinek et al. | 425/72.2 |
| 4,529,368 | 7/1985 | Makansi | 425/72.2 |

FOREIGN PATENT DOCUMENTS

| | | | |
|---|---|---|---|
| 46-34926 | 10/1971 | Japan | 264/237 |
| 53-9293 | 4/1978 | Japan | 264/237 |
| 57-161113 | 10/1982 | Japan | 264/211.14 |

*Primary Examiner*—Jan H. Silbaugh
*Assistant Examiner*—Jill L. Heitbrink
*Attorney, Agent, or Firm*—Scully, Scott, Murphy & Presser

[57] ABSTRACT

A melt spinning apparatus particularly applicable to a multifilament spinning for pitch based carbon fibers. The melt spinning apparatus is provided in which a flow uniforming member is attached to a central part on a spinning side of a spinneret having circularly or concentrically arranged nozzles, the flow uniforming member having a sectional diameter at least 3 mm smaller than the diameter of the innermost row of nozzles and a length not smaller than 2 cm. The apparatus is provided with a cooling means as an outer peripheral portion below a spinning pack having an annular blowing port for blowing a cooling gas toward the spun filaments. A gap is provided between the spinning pack and the cooling means and is sealed with a heat insulator.

4 Claims, 2 Drawing Sheets

MELT SPINNING APPARATUS

This is a continuation of copending application Ser. No. 833,739, filed on Feb. 26, 1986 now abandoned.

BACKGROUND OF THE INVENTION

The present invention relates to a melt spinning apparatus. More particularly, it is concerned with a melt spinning apparatus suitable for use in multifilament spinning for pitch-based carbon fibers.

In conventional melt spinning of high polymers, great efforts are made to prevent foreign matter from being deposited and growing on the vicinity of a spinneret nozzle which would be a main cause of problems in the spinning process, and also to prevent the breakage and unevenness in diameter of spun yarn. For example, in a melt spinning apparatus for such high polymers as polypropylene, nylon and polyester, usually a spinning pack, a delayed cooling portion and a forced cooling portion having a cooling air blowing face are arranged successively from above, and as a drawing zone for spun yarn, a quenching column is used over an area of at least 30 cm, usually 50 to 100 cm, to provide for a uniform cooling air temperature, humidity and wind velocity, and consideration is given to remove volatile matter or fumes contained in high polymers.

On the other hand, petroleum or coal pitch, as compared with the above-mentioned high polymers, is small in average molecular weight, ranging from about 600 to 2,000, and the molecular weight distribution thereof is not always narrow. From the standpoint of improving its spinnability and the performance of carbon fiber obtained by carbonizing pitch fiber, an attempt has been made to adjust the molecular weight distribution by subjecting pitch to a solvent fractionation and thereby removing low and high boiling components. During melt spinning, however, it is unavoidable for a trace amount of a low boiling component to become fume and stain in the vicinity of the spinneret and it is difficult to keep a stable spinning for a long time. Besides, because of a small average molecular weight, the dependence of melting viscosity upon temperature is extremely large and even a slight change in temperature causes a large change in viscosity. Further, the pitch spinning temperature is high, generally not lower than 300° C., and the viscosity is extremely low, ranging from 1,000 to 500,000 cP. Therefore, if a high tension is used with a view to obtaining a fine yarn under insufficient cooling, there will occur breakage of yarn, while if spun yarn is cooled excessively, it will be impossible to obtain a fine yarn because pitch fiber solidifies rapidly before it is drawn. Additionally, if cooling is not uniform, there will occur unevenness in yarn diameter.

SUMMARY OF THE INVENTION

It is the object of the present invention to overcome the problems involved in the conventional melt spinning apparatus and process.

The present inventors have found it essential for long-time stable spinning to properly control the drawing zone for pitch fiber obtained by spinning and to this end ensure uniform cooling for the pitch fiber by blowing and discharging a cooling gas smoothly. And on the basis of this finding we have succeeded in developing a melt spinning apparatus capable of cooling a number of spun filaments uniformly, thereby preventing both yarn breakage and unevenness in diameter, and ensuring stable spinning over a long time.

Accordingly, the present invention resides in a melt spinning apparatus in which a flow uniforming member is attached to a central part on a spinning side of a spinneret having circularly or concentrically arranged nozzles, the flow uniforming member having a sectional diameter which is smaller than, by at least 3 mm the diameter of the innermost row of nozzles and also which has a length of at least 2 cm; a cooling means having an annular blowing port for blowing a cooling gas toward spun filaments is provided as an outer peripheral portion below a spinning pack; and whereby a gap present between the spinning pack and the cooling means is sealed with a heat insulator.

PREFERRED EMBODIMENTS OF THE INVENTION

According to melt spinning operations usually adopted, spun filaments are cooled and drawn while blowing a cooling gas against the filaments. In this case, the cooling gas is heated by solidification heat or radiant heat and stagnates in a central part below the spinneret, so it is necessary to remove this heated gas downwards rapidly, otherwise it will become difficult to cool the spun filaments uniformly. In the present invention, a cooling gas blown against spun filaments from the outside of the filaments is conducted to the inside and then rapidly discharged vertically downwards by means of a flow uniforming member attached to a central part on a spinning side of a spinneret. As a result, it becomes possible to effect a uniform cooling for spun filaments.

The flow uniforming member used in the present invention, which has the foregoing dimensional characteristics, is a solid piece molded from a suitable material such as a metal, the solid molded piece being undeformable under working conditions. Preferably, it has a symmetrical shape. A cylindrical or truncated cone-like shape is particularly preferred.

The diameter of the flow uniforming member has a bearing on its distance from spun filaments adjacent thereto. Nozzles are arranged in one or more rows circularly or concentrically. It goes without saying that the diameter of the flow uniforming member is smaller than the diameter (pitch circle) of the innermost row of nozzles. In actual spinning, spun filaments are somewhat deflected by disturbance in addition to "deflection" caused by a cooling gas, so in order to prevent the filaments from contacting the flow uniforming member due to such deflection and causing breakage, it is preferable that the flow uniforming member have a sectional diameter which is smaller by at least 3 mm than the pitch circle of the innermost row. If the sectional diameter is smaller by more than 25 mm than the pitch circle, the present invention will become less effective. Therefore, the sectional diameter of the flow uniforming member is set to a value smaller by 3 to 25 mm, preferably 5 to 20 mm, than the pitch circle.

The length of the flow uniforming member is closely related to a drawing zone for spun yarn. If it is shorter than the length of the drawing zone, the present invention will not be fully effective. Therefore, the flow uniforming member is not shorter than 2 cm; for example, it is 2 to 20 cm, preferably 3.5 to 20 cm.

The melt spinning apparatus of the present invention has a cooling means as an outer peripheral portion below the spinning pack, the cooling means being sealed to the spinning pack through a heat insulator.

The cooling means has an annular blowing port for blowing a cooling gas against spun filaments from the outside of the filaments toward the inside.

In melt spinning, it is unavoidable for a low molecular weight component in the starting material to volatilize, while the gas, after its use for cooling the filaments is heated and becomes lower in density, so stagnates under the spinneret without going down and gradually diffuses horizontally just under the spinning pack. The flow uniforming member used in the present invention is very effective for rapidly discharging such fume downward. However, if a gap is present between the spinning pack and the cooling means, the fume will stay in the gap. Further, where the spinning pack and the cooling means are in direct contact with each other, there will occur a heat loss due to heat conduction, affecting the temperature distribution at the spinneret surface. In the present invention, this gap is sealed by inserting a heat insulator between the spinning pack and the cooling means, whereby both the stagnation of fume and the heat loss caused by heat conduction are prevented.

As the heat insulator there may be used, for example, an asbestos plate, asbestos-contained diatomaceous earth plate, rock wool. glass wool, calcium silicate plate, or Teflon plate. Of course, the heat insulator is not limited thereto.

The cooling means used in the present invention has an annular blowing port for blowing a cooling gas from the outside of spun filaments toward the inside. The cooling gas must be introduced below the spinneret without being blown directly against the spinneret surface. The spinneret is held at a predetermined temperature by a heating medium disposed around the spinning pack. Temperature difference must be kept to a minimum. The present inventors have found that direct blowing of cooling gas against the spinneret face would lead not only to enlargement of the temperature difference but also to a change of the spinneret temperature upon variation in the volume of the cooling gas, and further to a difference in the amount of pitch extruded between nozzle positions. Therefore, it is important to blow the cooling gas below the spinneret without directly applying it to the spinneret face.

A cooling gas blowing rate exceeding 30 cm/sec will cause a large deflection of spun fillaments and may cause breaking of the filaments. And if it is smaller than 1 cm/sec, it will be impossible to obtain a satisfactory cooling effect. A gas such as nitrogen or air is used as the cooling gas.

The flow uniforming member itself used in the invention may have a cooling means. In this case, an extremely effective cooling can be attained by introducing the cooling gas from a bottom or side face of the flow uniforming member and blowing it below the spinneret from outlet ports formed in the side face of the flow uniforming member. Together with the foregoing cooling means which blows the cooling gas from the outside of spun filaments toward the inside, a uniform cooling can be attained more easily.

Particularly, where nozzles are arranged in five or more rows in multifilament spinning, pitch filaments extruded from those rows of nozzles function as if they were a kind of curtain, so the cooling gas from the annular blowing port provided in an outer peripheral portion below the spinning pack is prevented from cooling the inside spun filaments to a satisfactory extent, thus making uniform cooling difficult.

In the present invention, where nozzles are arranged in four rows or less, sufficiently uniform cooling is ensured not only when the flow uniforming member is provided with a cooling means but also when it does not have a cooling means. However, where nozzles are arranged in five rows or more, it is extremely effective for the flow uniforming member to have a cooling means.

The cooling means of the flow uniforming member preferably has an inlet port for introducing the cooling gas from a bottom or side face (preferably a lower side face) of the flow uniforming member and also has outlet ports formed in its side face in the range of 3 to 35 mm beneath the spinneret which corresponds to the pitch fiber drawing zone. The cooling gas is introduced from the inlet port and ejected from the outlet ports without being blown directly against the spinneret face. In this case, the cooling gas blowing rate is in the range 1 to 30 cm/sec, preferably 1 to 15 cm/sec.

Figure 1:
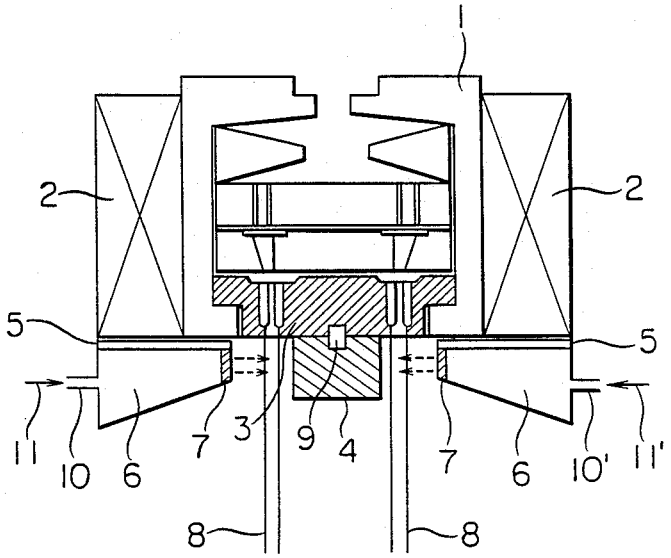
FIG. 1 illustrates a melt spinning apparatus according to an embodiment of the present invention.
Figure 2A:
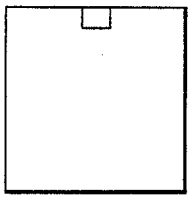
FIG. 2 illustrates examples of a flow uniforming member used in the present invention, in which (a) and (b) represent a cylinder and a truncated cone, respectively.
Figure 2B:
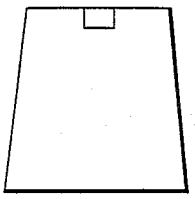
Figure 3A:
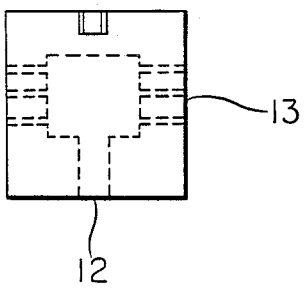
FIG. 3 illustrates flow uniforming members having cooling means.
Figure 3B:
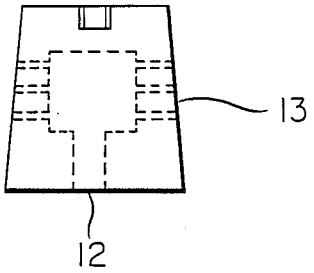
Figure 3C:
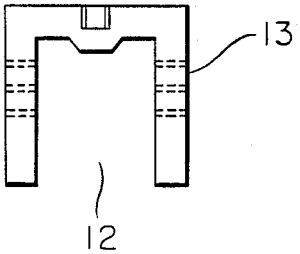
Figure 3D:
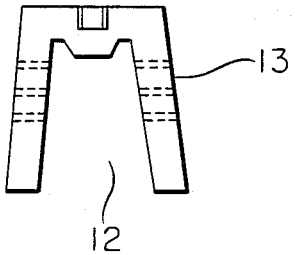
Figure 3E:
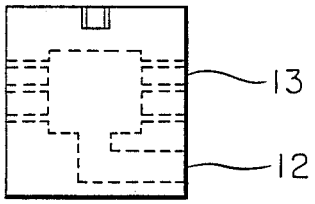

1: spinning pack
2: heater
3: spinneret
4: flow uniforming member
5: heat insulator
6: cooling means
7: cooling gas blowing port
8: spun filament
9: setscrew
10, 10': cooling gas inlet ports
11, 11': cooling gas
12: cooling gas inlet port
13: cooling gas outlet ports

What is claimed is:

1. A melt spinning apparatus for spinning coal and petroleum pitch to pitch fiber comprising:

a spinning pack;

a spinneret positioned within a lower end of said spinning pack, said spinneret having a plurality of circularly or concentrically arranged nozzles;

a heater assembly arranged concentrically about said spinning pack;

a flow uniforming member directly attached to and extending from a central part on a spinning side of said spinneret, said flow uniforming member having a sectional diameter at said spinneret which is at least 3 mm smaller than the diameter of the innermost row of nozzles of said spinneret, said flow uniforming member also having a length of between 2 cm and 20 cm; and a ring-shaped cooling means provided as an outer peripheral portion attached to said lower end of said spinning pack, said cooling means being concentric with and spaced from said flow uniforming member, said cooling means further having an annular blowing port for blowing a cooling gas toward spun filaments and said flow uniforming member, said cooling means being attached to said spinning pack through a heat insulating means;

wherein said flow uniforming member has an inlet port for the cooling gas, said inlet port being formed in a lower part of the flow uniforming member opposite said spinneret, and a plurality of cooling gas outlet ports formed in a side wall of said flow uniforming member which are opposite said cooling means to direct cooling gas towards said spun filaments and said cooling means form a direction directly opposite of said cooling means, said outlet ports being located between 3 and 35 mm from said spinneret.

2. A melt spinning apparatus according to claim 1, wherein the diameter of said flow uniforming member is smaller by 3 to 25 mm than the diameter of the innermost row of nozzles.

3. A melt spinning apparatus according to claim 1, wherein said flow unforming member is in the form of a cylinder or a truncated cone.

4. A melt spinning apparatus according to claim 1, wherein said flow uniforming member is made of a metal.

* * * * *